United States Patent [19]

Barnes

[11] Patent Number: 5,064,066

[45] Date of Patent: Nov. 12, 1991

[54] PACKAGE FOR SPOOLED PRODUCTS

[75] Inventor: Robert E. Barnes, Hinsdale, Ill.

[73] Assignee: Litton Systems, Inc., Des Plaines, Ill.

[21] Appl. No.: 674,180

[22] Filed: Mar. 25, 1991

[51] Int. Cl.[5] ..... B65D 85/67

[52] U.S. Cl. ..... 206/395; 206/401; 206/407; 206/409

[58] Field of Search ..... 206/389, 395, 396, 398, 206/400, 401, 407, 409

[56] References Cited

U.S. PATENT DOCUMENTS

| | | | |
|---|---|---|---|
| 1,691,995 | 11/1928 | Saulter | 206/395 |
| 1,826,084 | 10/1931 | Mohr | 206/409 X |
| 2,507,403 | 5/1950 | Gluck | 206/395 |
| 3,477,624 | 11/1969 | Branyon et al. | 206/395 X |
| 3,613,973 | 10/1971 | Jaeschke | 206/409 X |
| 3,744,698 | 7/1973 | Nederveld | 206/395 X |
| 4,382,510 | 5/1983 | Gaffney | 206/409 X |
| 4,582,198 | 4/1986 | Ditton | 206/389 X |
| 4,645,108 | 2/1987 | Gavin et al. | 206/395 X |

*Primary Examiner*—Paul T. Sewell
*Assistant Examiner*—Jacob K. Ackun, Jr.
*Attorney, Agent, or Firm*—Michael H. Wallach; Robert F. Rotella

[57] ABSTRACT

A protective cover is disclosed for covering material contained on spools, such as solder. The cover includes a plurality of tabs which are contained in a cavity to receive the spool. Each of the protective tabs has a horizontal slot engage a flange of the spool to retain the cover about the spool when the spool is placed in the cavity within the cover. One embodiment of the invention includes an elongated slot in one side of the cover to permit material stored on the spool to be withdrawn without removing the spool from the protective cover.

7 Claims, 1 Drawing Sheet

PACKAGE FOR SPOOLED PRODUCTS

FIELD OF THE INVENTION

This invention relates to packaging for spooled products in general and, in particular, to a protective cover for wire solder contained on cylindrical spools.

SUMMARY OF THE PRIOR ART

Spools have long been used to store and transport materials which may be wound onto the body of a spool. For example, wire, thread, or, more recently, optical fibers, can be wound onto a spool for transportation and/or for storage on the spool until such time as they are needed for use. This form of storage for transporting and storing material is particularly advantageous when the product contained on the spool is used sporadically, such that the remaining material requires a convenient place for storage. In many instances, the spooled product is placed in a cardboard box to protect the spool and the product contained thereon from damage in transit. When the product reaches the end user, the spooled product is removed from the box and the box is discarded. While the foregoing arrangements are satisfactory for many products contained on spools, it is not entirely satisfactory for products such as solder or optical fibers. Solder wire and optical fibers must be protected from environmental contamination and physical damage which would degrade or render useless the solder wire or optical fiber for its intended purpose.

SUMMARY OF THE INVENTION

A principle object of the invention is to provide an easily removed protective cover for spooled products while they are being shipped. Another object of the invention is to provide a protective cover for a spooled product which will be securely retained about the spooled product until such times it is desired to remove the protective package. Still another object of the invention is to provide a protective package for a spooled product which is made from a low cost material which may be easily discarded. Another object of the invention is to provide a protective cover for material shipped on a spool in which the cover has a substantial surface area to permit instructions for use and product warnings to be printed thereon.

The above and other objects and advantages of the invention are achieved by fabricating a protective cover from a readily discardable material, such as cardboard, to encircle and trap the spool containing a product such as wire, solder or optical fibers. One end of the cover is closed, for example with a series of flaps which fold onto each other and which may or may not be sealed with an adhesive or with tape. The other end of the cover is open to receive the spool. The open end of the cover contains two or more inward-facing tabs each of which contains a horizontal slot to receive and engage one end flange of the spool. In the preferred embodiment, the cover has a plurality of flat surfaces, for example six surfaces if the cover is made in the shape of a hexagon, to provide sufficient space to print product identification, instructions for use and product warnings, if appropriate. One face of the protective cover may have a perforated portion which can be pulled open to form a vertical slot or dispensing outlet through which material contained on the spool within the protective cover may be led from the spool to outside the protective cover for use. The horizontal slots contained in the tabs each securely engage the top flange of the spool to prevent the spool from slipping out of the protective cover. Due to the fact that one end of the protective cover is open while the spool is contained within the protective cover, the contents of the spool may be verified by viewing identification information printed on a label secured to the visible flange on the spool, or printed directly on the flange.

BRIEF DESCRIPTION OF THE DRAWING

The foregoing objects and other advantages of the invention will be readily understood by reference to the detailed description of a preferred embodiment when read in conjunction with the accompanying drawings in which.

DETAILED DESCRIPTION OF A PREFERRED EMBODIMENT

Figure 1:
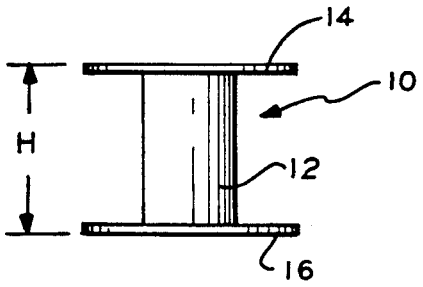
FIG. 1 is a side view of a spool which may be contained in the protective cover disclosed in the invention.

Referring to the drawing, FIG. 1 shows a spool 10 which may be used in conjunction with the invention. The spool includes a center core 12 and two flanges 14 and 16 secured to either end of the core 12. Material to be contained on the spool is wrapped around the core 12.

Figure 2:
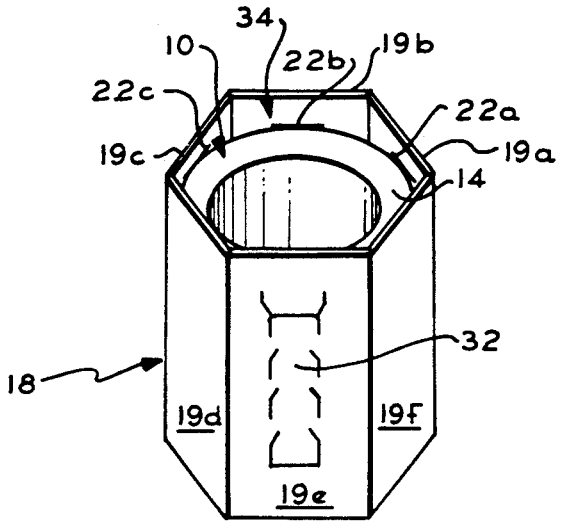
FIG. 2 is a perspective view of the invention.

FIG. 2 shows that the flanges 14 and 16 can be used to contain advertising and product information which may be desirable to supply to the user of the material contained on the spool 10. For example, when solder is wrapped on a spool 10, the flange 14 can be used to display the name of the manufacturer and the formulation of the solder contained on the spool as well as any other relevant product information or instructions for use, such as instructions on use of the product to obtain optimum results. However, due to the amount of space on the surface area of each flange 14 and 16, only a limited amount of information in an easily-readable type size can be printed on each flange. In addition, it would be advantageous to have a container to at least partially enclose the spool to permit handling of the spool without touching the material wrapped around the core 12 to avoid contaminating the material.

Figure 3:
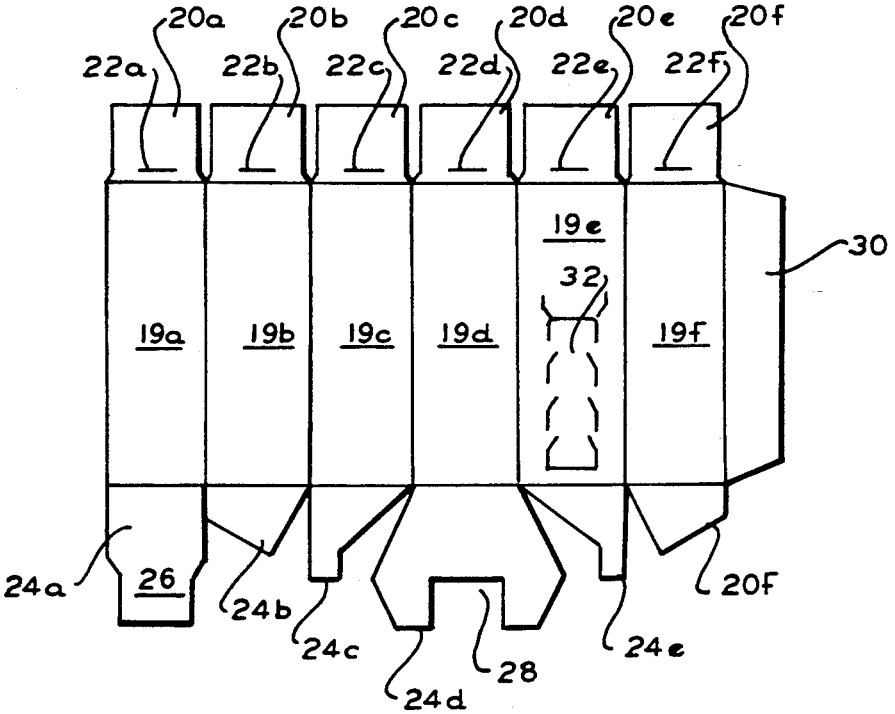
FIG. 3 is a disassembled view of the invention.

FIG. 2 shows an arrangement which will satisfy the foregoing objectives by enclosing a spool in a protective cover which is shown generally at 18. The preferred embodiment shows that the cover 18 is hexagonal in shape and is comprised of rectangular sides 19*a*–19*f*. FIG. 3 shows that each side 19*a*–19*f* has a folded over tab 20*a*–20*f* at the top end of each side. Each tab 20*a*–20*f* contains a horizontal depression or slit 22*a*–22*f*. The length of each side 19*a*–19*f* is made slightly larger than the overall height H of the spool. The bottom end of each side 19*a*–19*f* contains tabs 24*a*–24*f* which may be folded over when the cover 18 is assembled into a hexagonal shape to form a bottom for the cover 18. Preferably the tabs 24*a*–24*f* may be arranged to form a locking arrangement so that the bottom may be locked, for example with an extension 26 of tab 24*a* being received in a slit 28 contained in the tab 24*d* to prevent the bottom of the cover from opening up unintentionally, without the need for securing the flaps with adhesive.

FIG. 2 shows that one side, for example side 19*e*, contains an elongated perforated tab 32, which may be pulled down to open a slit on side 19*e* to permit material stored on a spool to be withdrawn from the cover 18. The foregoing arrangement would be advantageous when it is desired to retain the spool 10 in the cover 18 while still permitting access from time-to-time to the contents wound around the spool. For example, this would permit solder to be retained on the spool and withdrawn without the need for excessive handling and contamination of the solder.

FIG. 3 shows that the protective cover 18 may be formed by folding each of the sides 19*a*–19*f* so that a flap 30 may be glued, taped, stapled or otherwise fastened to side 18*a*. Thereafter, each of the tabs 20*a*–20*f* are folded into the cavity 34 formed by the enclosed sides 19*a*–19*f* and the tabs 24*a*–24*f* are folded over and the extension 26 of tab 24*a* is placed in slit 28 to lock the tabs 26*a*–26*f* together to form the bottom of the cavity 32. A spool 10 may thereafter be dropped into the cavity 32 and the upper flange 14 will engage each of the slits 22*a*–22*f* to lock the cover 18 about the spool 10.

While the foregoing is a description of a preferred embodiment of the invention, it should be understood by those skilled in the art that various other modifications may be made to the invention without departing from the spirit and scope of the invention, the intention being to have the invention limited only by the permissible scope of interpretation of the claims.

I claim:

1. A protective cover for a product contained on a spool, said spool having a core and flanges having edges, said flanges being fastened to the top and bottom of said core, the protective cover surrounding the spool and being comprised of:

A. A plurality of rectangular side pieces for surrounding the length of said spool, said side pieces forming a cavity when folded to receive the spool, each of said side pieces being slightly longer than the length of said spool, each of said side pieces having a top edge and a bottom edge; and B. At least two tabs, each of said tabs comprising an extension of one of said side pieces at the top edge of said side pieces, each of said tabs having a horizontal slot, each of said tabs being folded over into the cavity of said protective cover to place the horizontal slot on each tab within said cavity when said tabs are folded into said cavity, said horizontal slots being located to receive the edge of one of said flanges when said spool is placed within the cavity formed by said protective cover to retain said spool within said protective cover.

2. The protective cover of claim 1 further including tabs comprising an extension of said side pieces at the bottom edge of one or more of said side pieces, the tabs at the bottom edge of said side pieces forming a bottom cover for said cavity when said tabs comprising an extension of the bottom edge of said side pieces are folded into a plane substantially orthogonal to the planes of each of said side pieces.

3. The protective cover of claim 1 wherein one of said side pieces contains a perforated tab, said perforated tab covering a vertical slot in said side piece to permit material stored on said spool to be removed through said protective cover.

4. The protective cover of claim 2 wherein at least two of said tabs comprising extensions of the bottom edges of said side pieces lock into each other to form a bottom for said cavity.

5. The protective cover of claim 4 wherein each of said side pieces includes tabs comprising an extension of the top edge of each side piece, said tabs comprising an extension of the top edge of each side piece being folded into the cavity in said protective cover.

6. The protective cover of claim 5 wherein each of the tabs comprising an extension of the top edge of each side piece contains a horizontal slot for receiving the edge of a flange of a spool received in the cavity in said cover.

7. The protective cover of claim 3 wherein the vertical slot is opened by stripping down the perforated tab prior to the first use of the product on the spool.

* * * * *